US005888402A

United States Patent [19]

Hommeltoft et al.

[11] Patent Number: 5,888,402

[45] Date of Patent: Mar. 30, 1999

[54] PROCESS FOR THE PURIFICATION OF A HYDROCARBON STREAM

[75] Inventors: Sven Ivar Hommeltoft, Hillerød; Ole Ekelung, Lyngby, both of Denmark

[73] Assignee: Haldor Topsoe A/S, Lyngby, Denmark

[21] Appl. No.: 874,893

[22] Filed: Jun. 13, 1997

[30] Foreign Application Priority Data

Jun. 17, 1996 [DK] Denmark ..... 0668/96

[51] Int. Cl.[6] ..... B01D 15/00

[52] U.S. Cl. ..... 210/690; 502/405; 502/408; 585/822; 585/824; 585/826; 585/850

[58] Field of Search ..... 585/820, 822, 585/823, 824, 850, 826; 502/408, 405; 210/690

[56] References Cited

U.S. PATENT DOCUMENTS

| | | | |
|---|---|---|---|
| 3,940,972 | 3/1976 | Norell et al. . | |
| 3,970,721 | 7/1976 | Brockington et al. . | |
| 4,103,096 | 7/1978 | Giolito et al. | 568/783 |
| 4,677,231 | 6/1987 | Aoshima et al. . | |
| 4,968,433 | 11/1990 | Schmidt et al. . | |
| 5,057,473 | 10/1991 | Voeks et al. | 502/73 |
| 5,220,099 | 6/1993 | Schreiner et al. . | |
| 5,360,547 | 11/1994 | Cockett et al. . | |
| 5,396,018 | 3/1995 | Hommeltoft | 585/724 |
| 5,571,762 | 11/1996 | Clerici et al. | 502/155 |
| 5,607,890 | 3/1997 | Chen et al. | 502/202 |
| 5,659,105 | 8/1997 | Clerici et al. | 585/730 |

*Primary Examiner*—Jay H. Woo
*Assistant Examiner*—Betsey J. Morrison
*Attorney, Agent, or Firm*—Ostrolenk, Faber, Gerb & Soffen, LLP

[57] ABSTRACT

Process for the purification of a hydrocarbon stream by removing contaminating compounds contained in the hydrocarbon stream by contact with a solid adsorbent material and withdrawing a purified hydrocarbon stream, the improvement of which comprises passing the hydrocarbon stream through a first zone of the adsorbent material having supported thereon a fluorinated sulphonic acid and subsequently through zone of the adsorbent material.

17 Claims, No Drawings

PROCESS FOR THE PURIFICATION OF A HYDROCARBON STREAM

FIELD OF INVENTION

The present invention relates to a process for the purification of a hydrocarbon stream by contacting the stream in presence of an acid with a solid adsorbent material and adsorbing impurities in the hydrocarbon stream on the adsorbent material.

BACKGROUND OF THE INVENTION

It is known that impurities can be removed from different media by adsorption treatment in a fixed bed of solid adsorbents (U.S. Pat. No. 5,360,547, U.S. Pat. No. 5,220,099, U.S. Pat. No. 4,677,231). Use of sulphonic acid containing activated carbon in the removal of organic cations from polar liquids is, furthermore, disclosed in U.S. Pat. No. 4,968,433.

SUMMARY OF THE INVENTION

It has now been found that impurities can be removed efficiently from a non-polar hydrocarbon stream by contacting the stream with solid adsorbent material having supported thereon a fluorinated sulphonic acid.

Based on the above finding, this invention provides an improved process for the purification of a hydrocarbon stream by removing contaminants contained in the hydrocarbon stream by contact with a solid adsorbent material and withdrawing a purified hydrocarbon stream, the improvement of which comprises passing the hydrocarbon stream through a first zone of the adsorbent material having supported thereon a fluorinated sulphonic acid and subsequently through a second zone of the adsorbent material without adsorbed fluorinated sulphonic acid.

DETAILED DESCRIPTION OF THE PREFERRED EMBODIMENT

The invention is, in particular, useful in the removal of impurities being present in an effluent stream from acid catalyzed alkylation of hydrocarbons. Thereby, sulphur compounds such as thiophene, benzothiophene and dibenzothiophene contained in the effluent stream are substantially removed by passing the stream through a bed of preferably silica gel material having supported in a zone of the material trifluoromethanesulphonic acid.

The advantage compared to the known sulphuric acid sweetening process is an effective contact between the supported acid and the hydrocarbon stream without the need for agitation. Higher acidity of the fluorinated sulphonic acid enhances adsorption of less polar impurities and thus renders the adsorption process more versatile and effective.

Spent adsorbent material may be regenerated in several ways. A zone of fresh added acid is passed through the bed whereby impurities adsorbed on the adsorbent are desorbed from the bed by dissolution into the acid. After the acid zone has passed through the bed, the remaining acid is removed by flushing the bed with a hydrocarbon stream optionally containing olefinic hydrocarbons and optionally at elevated temperature (50°–200° C.). After regeneration of the adsorbent, acid is added to the adsorbent for use in a subsequent purification cycle.

Alternatively, the adsorbent is washed with water followed by drying and calcination at elevated temperature. After cooling, acid is added to the adsorbent, prior to being used in a subsequent purification cycle.

EXAMPLES

Comparison Example 1

Removal of Coloured Impurities from Alkylate Using Activated Carbon 155 ml of yellowish alkylate (UV/VIS absorbents at 400 nm=1.01) were passed through a column containing 4.8 ml of activated carbon (Darco, granular, 20–40 mesh). The flow rate was 3.9 ml/min. Different samples of the purified alkylate were collected. In Table 1 the amounts of alkylate samples are expressed as volume per column volume. The colour intensity of each sample was measured by UV/VIS absorption at 400 nm. The results of the purification are summarized in Table 1.

TABLE 1

| Portion of purified alkylate vol./column vol. | UV/VIS Absorbents 400 nm |
|---|---|
| 0–4.2 | 0.03 |
| 4.2–9.4 | 0.09 |
| 9.4–15.2 | 0.14 |
| 15.2–20.8 | 0.22 |
| 20.8–26.9 | 0.26 |
| 26.9–32.3 | 0.32 |

Comparison Example 2

Removal of Coloured Impurities from Alkylate Using Silica Gel 134 ml of yellowish alkylate (UV/VIS absorbents at 400 nm=1.28) was passed through a column containing 4.8 ml silica gel (Merck 100, 0.2–0.5 mm). The flow rate was 0.73 ml/min. and samples of the purified alkylate were collected. The colour intensity of each sample was measured by UV/VIS absorption at 400 nm. The results of the purification are summarized in Table 2.

TABLE 2

| Portion of purified alkylate vol./column volume | UV/VIS Absorbents 400 nm |
|---|---|
| 0–2.9 | 0.03 |
| 2.9–5.2 | 0.18 |
| 5.2–8.3 | 0.34 |
| 8.3–12.7 | 0.42 |
| 12.7–16.9 | 0.46 |
| 16.9–19.8 | 0.48 |
| 19.8–24.2 | 0.50 |
| 24.2–27.9 | 0.52 |

Example 3

Removal of Coloured Impurities from Alkylate on Silica Gel Supporting Trifluoromethanesulphonic Acid 2300 ml of yellowish alkylate (UV/VIS absorbents at 400 nm) were passed through a column containing 25 ml silica gel (Merck 100, 0.2–0.5 mm). The gel was wetted with 10 ml trifluoromethanesulphonic acid in a first zone. Beneath the first zone, 125 ml silica gel (Merck 100, 0.2–0.5 mm) were placed in a second zone. In order to reduce alkylate cracking, the inlet temperature was kept at −15° C. The flow rate was 7.1 ml/min. The decolorized alkylate was collected in samples. The colour intensity of each sample was measured by UV/VIS absorption at 400 nm. In Table 3 the amount of alkylate samples is expressed as volume per column volumes. The results of the purification are summarized in Table 3.

TABLE 3

| Portion of purified alkylate Vol./column volumes | UV/VIS Absorbents 400 nm |
|---|---|
| 0–1.3 | 0.00 |
| 1.3–2.7 | 0.00 |
| 2.7–4.0 | 0.00 |
| 4.0–5.3 | 0.00 |
| 5.3–6.7 | 0.00 |
| 6.7–9.3 | 0.01 |
| 9.3–15.3 | 0.04 |

Example 4

For the adsorption of thiophene derivatives a solution of 0.77% thiophene (T), 0.96% benzothiophene (BT) and 0.80% dibenzothiophene (DBT) in hexane was passed through a column with 17 ml silica gel on which 3.0 ml trifluoromethanesulphonic acid were placed. The feedflow was 4.5 ml/min. at a temperature of 20–25° C.

The composition of the effluent stream was determined by GC in samples collected after passage of varying amounts of the above solution through the column. The first effluent sample from the column contained no detectable concentrations of the sulphur compounds in the feed stream. A sample taken after 12 ml of the solution had passed through the column showed no thiophene, no benzothiophene, and 0.05% dibenzothiophene. After passage of 25 ml solution, the DBT content in the effluent had increased to 0.58%, whereas none of the other sulphur compounds had been detected. After passage of 40 ml solution the DBT content in the effluent stream reached a level of 0.72% whereas the content of T and BT remained below the detection limit (30 ppm). A sample taken after the passage of 146 ml solution had almost essentially the same composition as the sample taken after 40 ml. However, after passage of 170 ml solution, T and BT appeared in the product at a concentration of 0.18% and 0.34% respectively, whereas the content of DBT was the same as in the feed 0.80% (all percentages are w/w).

Example 5

Decolouration of diesel oil.

20 ml hydrotreated diesel oil (yellow colour, a blue/green fluorescence and a sulphur content of 206 ppm including 41 ppm 4,6-dimethyl-dibenzothiophene) were stirred with 6 ml trifluoromethanesulphonic acid at 0° C. After 2 min. a 10 ml sample was removed and washed with water. The sample was colourless without any fluorescence. The sulphur content was measured to be 137 ppm including 10 ppm 4,6-dimethyl-dibenzothiophene.

We claim:

1. In a process for the purification of a hydrocarbon stream by removing contaminating compounds contained in the hydrocarbon stream by contact with a solid adsorbent material and withdrawing a purified hydrocarbon stream, the improvement comprising:

passing the hydrocarbon stream through a first zone of the adsorbent material having supported thereon a fluorinated sulphonic acid, said fluorinated sulphonic acid being supported on said adsorbent material prior to the passing of the hydrocarbon stream; and subsequently passing the hydrocarbon stream through a second zone of the adsorbent material without any fluorinated sulphonic acid supported thereon, wherein the fluorinated sulphonic acid supported on the adsorbent material in the first zone aids in the removal of said contaminating compounds.

2. Process according to claim 1, wherein the fluorinated sulphonic acid is trifluoromethanesulphonic acid.

3. Process according to claim 1, wherein the adsorbent material is silica gel.

4. The process according to claim 1 wherein the hydrocarbon stream to be purified is a stream of alkylated hydrocarbon.

5. The process according to claim 1 wherein the hydrocarbon stream to be purified is a stream of diesel oil.

6. The process according to claim 1, wherein the contaminating compounds to be removed include thiophene or derivatives thereof.

7. A process for the purification of a hydrocarbon stream comprising the steps of:

providing a bed of adsorbent material including a first zone having a fluorinated sulphonic acid supported on the adsorbent material and a second zone without any fluorinated sulphonic acid supported on the adsorbent material;

causing impurities to be removed from the hydrocarbon stream by passing the stream through the first zone of adsorbent material and subsequently through the second zone of adsorbent material, wherein the fluorinated sulphonic acid supported on the adsorbent material in the first zone aids in the removal of said impurities.

8. The process according to claim 7, wherein the fluorinated sulphonic acid is trifluoromethanesulphonic acid.

9. The process according to claim 7, wherein the adsorbent material is silica gel.

10. The process according to claim 7, wherein the hydrocarbon stream to be purified is a stream of alkylated hydrocarbon.

11. The process according to claim 7, wherein the hydrocarbon stream to be purified is a stream of diesel oil.

12. The process according to claim 7, wherein the contaminating compounds to be removed include thiophene or derivatives thereof.

13. The process according to claim 7, further comprising the step of regenerating the adsorbent material.

14. The process according to claim 13, wherein the step of regenerating the adsorbent material includes the steps of:

passing a regenerating acid stream through the bed to desorb the impurities adsorbed on the adsorbent material by dissolution into the regenerating acid; and removing any remaining regenerating acid from the bed by flushing the bed with a second hydrocarbon stream.

15. The process according to claim 14, wherein the second hydrocarbon stream contains olefinic hydrocarbons.

16. The process according to claim 14, wherein the second hydrocarbon stream is passed through the bed of adsorbent material at an elevated temperature of between 50° to 200° C.

17. The process according to claim 13, wherein the step of regenerating the adsorbent material includes the steps of:

washing the adsorbent material having impurities adsorbed thereon with water; and drying and calcining the adsorbent material at an elevated temperature.

* * * * *